US010152014B2

(12) United States Patent
Kawanago

(10) Patent No.: US 10,152,014 B2
(45) Date of Patent: Dec. 11, 2018

(54) CLEANING APPARATUS, IMAGE FORMING APPARATUS AND CLEANING METHOD

(71) Applicant: Konica Minolta, Inc., Chiyoda-ku, Tokyo (JP)

(72) Inventor: Takashi Kawanago, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/351,480

(22) Filed: Nov. 15, 2016

(65) Prior Publication Data

US 2017/0139371 A1 May 18, 2017

(30) Foreign Application Priority Data

Nov. 17, 2015 (JP) ..... 2015-224354

(51) Int. Cl.
*G03G 21/00* (2006.01)
*G03G 21/02* (2006.01)
*G03G 15/16* (2006.01)

(52) U.S. Cl.
CPC ..... *G03G 21/0029* (2013.01); *G03G 15/161* (2013.01); *G03G 21/0011* (2013.01); *G03G 21/02* (2013.01)

(58) Field of Classification Search
CPC ..... G03G 21/0029; G03G 21/02
See application file for complete search history.

(56) References Cited

U.S. PATENT DOCUMENTS 4,417,802 A * 11/1983 Forbes, II ..... G03G 15/0877 222/105
5,218,412 A * 6/1993 Martin ..... G03G 21/0029 15/256.5
5,282,010 A * 1/1994 Popovic ..... G03G 15/754 271/308
6,311,031 B1 * 10/2001 Hirano ..... G03G 15/168 399/101
6,591,072 B2 7/2003 Hashimoto et al.
2011/0311286 A1 * 12/2011 Thayer ..... G03G 21/0029 399/350

(Continued)

FOREIGN PATENT DOCUMENTS

JP 04352186 A 12/1992
JP 2002-139891 A 5/2002

(Continued)

OTHER PUBLICATIONS

JP_2011141377_A_T MachineTranslation, Ishida, Japan, 2011.*

(Continued)

*Primary Examiner* — Victor Verbitsky
(74) *Attorney, Agent, or Firm* — Buchanan Ingersoll & Rooney PC

(57) ABSTRACT

A cleaning apparatus which cleans an image carrier that has an elastic layer after a toner image formed on the image carrier is transferred onto a transfer object, the cleaning apparatus including: a cleaning blade which contacts the image carrier and removes a residue attached to the image carrier; a change section which changes a cleaning condition of cleaning by the cleaning blade; and a hardware processor which controls the change section to change the cleaning condition in accordance with deterioration of the image carrier.

4 Claims, 9 Drawing Sheets

(56) References Cited

U.S. PATENT DOCUMENTS

2013/0089356 A1 4/2013 Yamaki et al.

FOREIGN PATENT DOCUMENTS

| | | | | |
|---|---|---|---|---|
| JP | 2003215948 | A | | 7/2003 |
| JP | 2007-183684 | A | | 7/2007 |
| JP | 2007183684 | A | * | 7/2007 |
| JP | 2011107534 | A | | 6/2011 |
| JP | 2011141377 | A | * | 7/2011 |
| JP | 2011-186311 | A | | 9/2011 |
| JP | 2012155101 | A | | 8/2012 |
| JP | 2014-145913 | A | | 8/2014 |

OTHER PUBLICATIONS

JP_2007183684_A_T Machine Translation, Japan, Watanabe.*
The extended European Search Report dated Mar. 21, 2017, by the European Patent Office in corresponding European Patent Application No. 16198985.0-1568. (8 pages).
Notification of Reasons for Refusal (Office Action) issued by the Japanese Patent Office dated Oct. 31, 2017 in Japanese Patent Application No. 2015-224354 and English translation (15 pages).

* cited by examiner

CLEANING APPARATUS, IMAGE FORMING APPARATUS AND CLEANING METHOD

BACKGROUND OF THE INVENTION

1. Field of the Invention

The present invention relates to a cleaning apparatus, an image forming apparatus and a cleaning method.

2. Description of Related Art

As an electrophotographic image forming apparatus, for example, there has been conventionally an intermediate transfer type image forming apparatus which forms toner images of Y (yellow), M (magenta), C (cyan) and K (black) on separate photoreceptor drums, primarily transfers the toner images of respective Y, M, C and K colors formed on the respective photoreceptor drums onto a rotating intermediate transfer belt so as to be superposed on each other and thereafter secondarily transfers the respective superposed toner images transferred on the intermediate transfer belt onto a sheet of paper.

The intermediate transfer belt formed of a resin material such as polyimide and polyphenylene sulfide is generally and widely used. However, due to the microscopic irregularities in surface shape of paper to be used (for example, plain paper, thin coated paper and board paper), the contact between an intermediate transfer belt and a sheet at the secondary transfer position is lowered, and thus it is difficult to ensure the transfer property in some cases.

In order to prevent such decrease in transfer property, there is an intermediate transfer belt which has an elastic layer of rubber material or the like on a substrate layer formed of a resin material (see Japanese Patent Application Laid Open Publication No. 2011-107534). The elastic layer enables the intermediate transfer belt to have the surface shape deformed so as to fit the surface shape of sheet, and thus improves the contact between the intermediate transfer belt and the sheet.

It is desired that all toner images are transferred onto a sheet when transferring the toner images on an intermediate transfer belt onto the sheet. However, there are actually cases where a part of the toner particles are not transferred and remain on the intermediate transfer belt. There are also cases where paper powders are attached to the intermediate transfer belt due to the contact between the sheet and the intermediate transfer belt. If such residues of residual toners and paper powders remain attached to the intermediate transfer belt, the formation of toner images thereafter is disturbed. Thus, the image forming apparatus is provided with a cleaning apparatus which removes residues on the intermediate transfer belt.

The cleaning apparatus generally has a configuration of scraping and removing the residues on the intermediate transfer belt by making the tip of a cleaning blade formed of an elastic body such as urethane rubber come into contact with the rotating intermediate transfer belt. However, when the intermediate transfer belt has an elastic layer, the elastic bodies of the intermediate transfer belt and the cleaning blade contact each other, which may turn the blade by the torque increase. Thus, there is also used a cleaning apparatus which applies a cleaning blade formed of a thin metal piece (see Japanese Patent Application Laid Open Publication No. H4-352186).

However, even in the cleaning blade made of metal, the tip thereof is gradually worn away while cleaning the residues such as residual toners and paper powders on the intermediate transfer belt over a long period, which makes it difficult to appropriately remove the residues in some cases. Furthermore, the intermediate transfer belt having an elastic layer has a problem that the belt surface is hardened with its use.

In a case where a cleaning blade made of metal contacts the intermediate transfer belt having an elastic layer, the cleaning blade is pressed down into the belt surface while the intermediate transfer belt is soft (see FIG. 5). However, as the intermediate transfer belt becomes harder, the pressing down of cleaning blade into the belt surface is reduced. Thus, the angle (edge angle) between the intermediate transfer belt and the cleaning blade is possibly changed and causes a cleaning defect such as a vertical line and an uncleaned part in some cases.

SUMMARY OF THE INVENTION

The present invention has been made in consideration of the above problems in conventional technique, and an object of the present invention is to maintain a cleaning property over a long period for cleaning of an image carrier having an elastic layer.

In order to achieve at least one of the above objects, according to one aspect of the present invention, there is provided a cleaning apparatus which cleans an image carrier that has an elastic layer after a toner image formed on the image carrier is transferred onto a transfer object, the cleaning apparatus including: a cleaning blade which contacts the image carrier and removes a residue attached to the image carrier; a change section which changes a cleaning condition of cleaning by the cleaning blade; and a hardware processor which controls the change section to change the cleaning condition in accordance with deterioration of the image carrier.

Preferably, in the above cleaning apparatus, the change section changes an edge angle as the cleaning condition, the edge angle being an angle between an end surface of a tip of the cleaning blade and a surface of the image carrier.

Preferably, in the above cleaning apparatus, the hardware processor controls the change section at a predetermined timing to make the edge angle smaller than the edge angle before the predetermined timing.

Preferably, in the above cleaning apparatus, the cleaning blade has a rotation shaft along a width direction of the image carrier, the rotation shaft being located at a position which has different lengths from respective ends of the cleaning blade, the change section rotates the cleaning blade around the rotation shaft, and the hardware processor controls the change section at the predetermined timing to change a contact state from a state in which the end of the cleaning blade having a longer length from the rotation shaft contacts the image carrier to a state in which the end of the cleaning blade having a shorter length from the rotation shaft contacts the image carrier.

Preferably, in the above cleaning apparatus, the change section changes a positional relationship between the cleaning blade and a roller facing the cleaning blade via the image carrier, and the hardware processor controls the change section at the predetermined timing to make a distance between the cleaning blade and the roller shorter than the distance before the predetermined timing.

Preferably, in the above cleaning apparatus, the hardware processor controls the change section so that a position where the cleaning blade contacts the image carrier is different from a position where the roller contacts the image carrier.

Preferably, in the above cleaning apparatus, the predetermined timing is when a number of the transfer object having the toner image transferred from the image carrier exceeds a predetermined value.

Preferably, in the above cleaning apparatus, the predetermined timing is when an amount of toner consumption exceeds a predetermined amount.

Preferably, in the above cleaning apparatus, the cleaning blade has a plurality of corners contactable with the image carrier.

According to another aspect of the present invention, there is provided an image forming apparatus including the cleaning apparatus.

According to another aspect of the present invention, there is provided a cleaning method for a cleaning apparatus which includes a cleaning blade, a change section and a hardware processor and cleans an image carrier that has an elastic layer after a toner image formed on the image carrier is transferred onto a transfer object, the cleaning method including: contacting the image carrier and removing a residue attached to the image carrier with the cleaning blade; changing a cleaning condition of cleaning by the cleaning blade with the change section; and controlling the change section to change the cleaning condition in accordance with deterioration of the image carrier with the hardware processor.

Preferably, in the above cleaning method, the change section changes an edge angle as the cleaning condition, the edge angle being an angle between an end surface of a tip of the cleaning blade and a surface of the image carrier.

Preferably, in the above cleaning method, the hardware processor controls the change section at a predetermined timing to make the edge angle smaller than the edge angle before the predetermined timing.

Preferably, in the above cleaning method, the cleaning blade has a rotation shaft along a width direction of the image carrier, the rotation shaft being located at a position which has different lengths from respective ends of the cleaning blade, the change section rotates the cleaning blade around the rotation shaft, and the hardware processor controls the change section at the predetermined timing to change a contact state from a state in which the end of the cleaning blade having a longer length from the rotation shaft contacts the image carrier to a state in which the end of the cleaning blade having a shorter length from the rotation shaft contacts the image carrier.

Preferably, in the above cleaning method, the change section changes a positional relationship between the cleaning blade and a roller facing the cleaning blade via the image carrier, and the hardware processor controls the change section at the predetermined timing to make a distance between the cleaning blade and the roller shorter than the distance before the predetermined timing.

Preferably, in the above cleaning method, the hardware processor controls the change section so that a position where the cleaning blade contacts the image carrier is different from a position where the roller contacts the image carrier.

Preferably, in the above cleaning method, the predetermined timing is when a number of the transfer object having the toner image transferred from the image carrier exceeds a predetermined value.

Preferably, in the above cleaning method, the predetermined timing is when an amount of toner consumption exceeds a predetermined amount.

Preferably, in the above cleaning method, the cleaning blade has a plurality of corners contactable with the image carrier.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

First Embodiment

A first embodiment of an image forming apparatus according to the present invention will be described. The present invention is not limited to the illustrated example.

Figure 1:
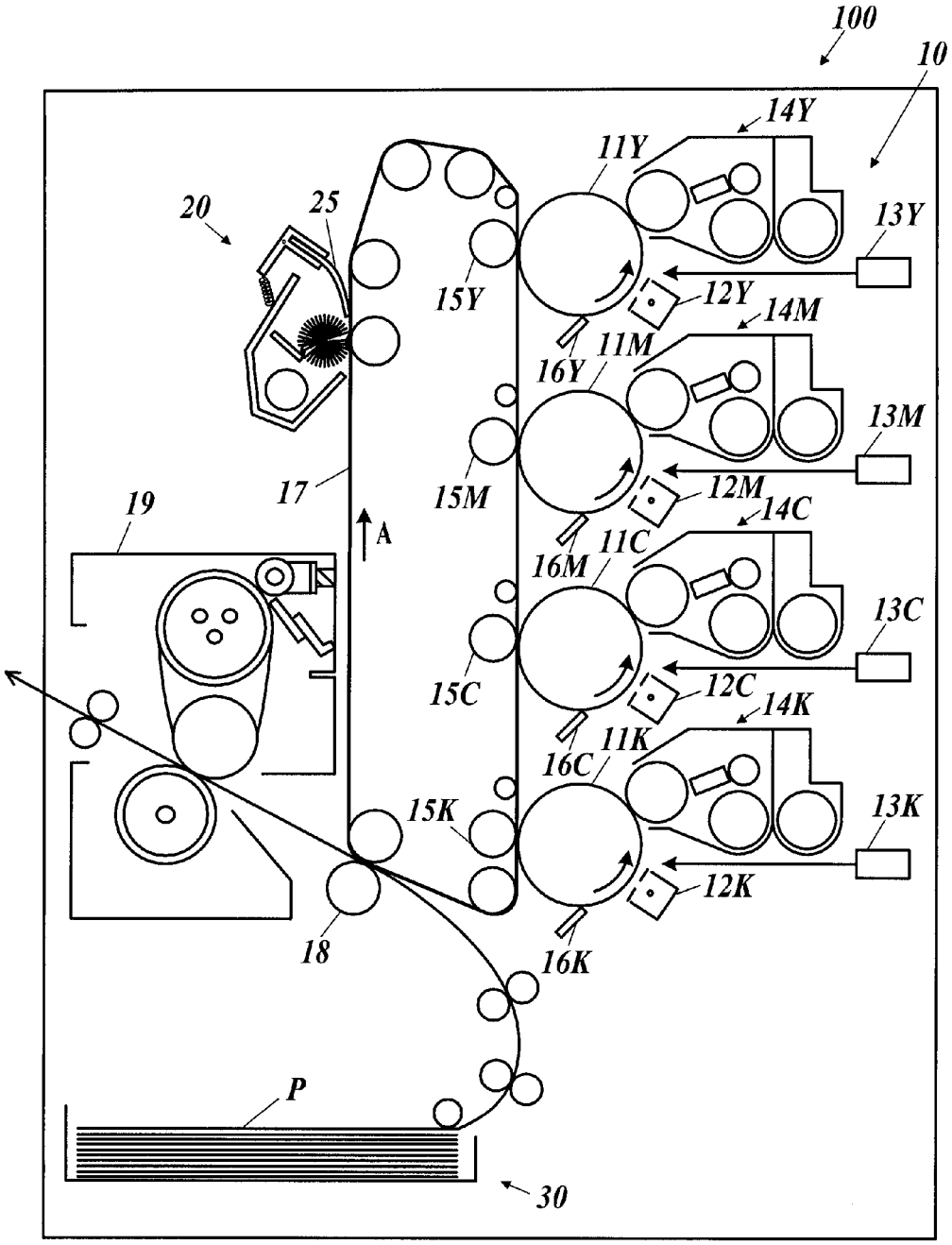
FIG. 1 is a schematic configuration view of an image forming apparatus in a first embodiment.

FIG. 1 shows a schematic configuration of an image forming apparatus 100 in the first embodiment.

As shown in FIG. 1, the image forming apparatus 100 includes an image forming section 10, a belt cleaning section 20, a paper feeding section 30 and such like.

The image forming section 10 includes photoreceptor drums 11Y, 11M, 11C and 11K, charging sections 12Y, 12M, 12C and 12K, exposure sections 13Y, 13M, 13C and 13K, developing sections 14Y, 14M, 14C and 14K, primary transfer rollers 15Y, 15M, 15C and 15K, photoreceptor cleaning sections 16Y, 16M, 16C and 16K which are corresponding to respective colors of yellow (Y), magenta (M), cyan (C) and black (K), an intermediate transfer belt 17 as an image carrier, a secondary transfer roller 18 and a fixing section 19.

The charging sections 12Y, 12M, 12C and 12K uniformly charge the respective photoreceptor drums 11Y, 11M, 11C and 11K.

The exposure sections 13Y, 13M, 13C and 13K are configured by including laser light sources, polygon mirrors, lens and such like, and form electrostatic latent images by scanning and exposing the surfaces of respective photoreceptor drums 11Y, 11M, 11C and 11K with laser beams on the basis of the image data of the respective colors.

The developing sections 14Y, 14M, 14C and 14K attach the toners of respective colors to the electrostatic latent images on the photoreceptor drums 11Y, 11M, 11C and 11K.

The primary transfer rollers 15Y, 15M, 15C and 15K sequentially transfer the toner images of respective colors formed on the photoreceptor drums 11Y, 11M, 11C and 11K onto the intermediate transfer belt 17 (primary transfer). That is, a color toner image of superposed toner images in four colors is formed on the intermediate transfer belt 17.

The photoreceptor cleaning sections 16Y, 16M, 16C and 16K remove the toners remaining on the circumferential surface of the respective photoreceptor drums 11Y, 11M, 11C and 11K after transferring.

The intermediate transfer belt 17 is an endless belt having an elastic layer, tensioned by a plurality of rollers and rotated in the direction shown by the arrow A.

The intermediate transfer belt 17 has a substrate layer formed of resin such as polyimide (PI) and polyphenylene sulfide (PPS) and an elastic layer which is provided on the substrate layer and formed of rubber such as acrylonitrile-butadiene copolymer rubber (NBR) and chloroprene rubber (CR). As for the thickness of each layer in the intermediate transfer belt 17, it is preferable that the thickness of substrate layer is approximately 50 to 100 μm in consideration of belt conveyance and workability when exchanging the belt. In order to enhance the transfer property onto the sheet P having irregularities, it is preferable that the thickness of elastic layer is approximately 100 to 500 μm. Further, a surface layer having hardness higher than that of elastic layer may be provided on the surface of the elastic layer in order to reduce the tackiness. For example, there may be provided an oxidative treatment layer of approximately 5 to 20 μm or a coat layer such as fluorine resin of approximately 30 to 50 μm.

The secondary transfer roller 18 transfers all the color toner images formed on the intermediate transfer belt 17 at once onto one surface of the sheet P as a transfer object supplied from the paper feeding section 30 (secondary transfer).

The fixing section 19 fixes the toners transferred on the sheet P to the sheet P by heating and pressing.

The belt cleaning section 20 cleans the intermediate transfer belt 17 by removing residues such as residual toners and paper powders, which remains without being transferred onto the sheet P, from the intermediate transfer belt 17 after the color toner images were transferred onto the sheet P by the secondary transfer roller 18.

Figure 2:
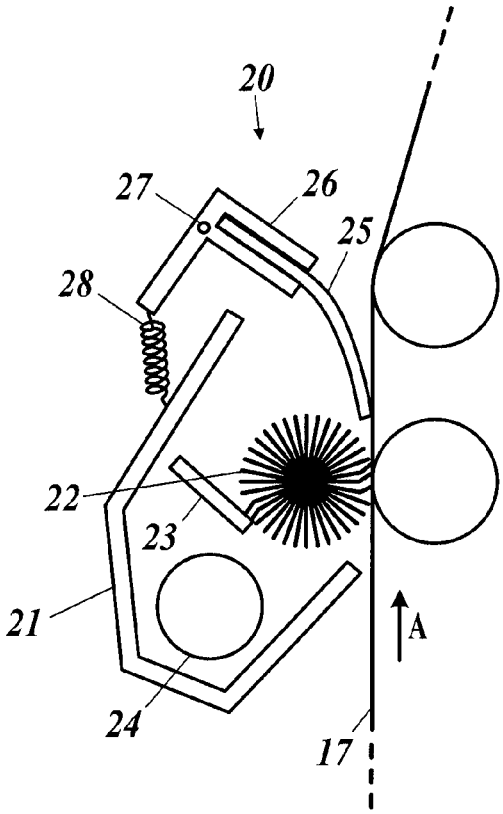
FIG. 2 is a view showing a configuration of a belt cleaning section.

FIG. 2 shows the configuration of the belt cleaning section 20.

The belt cleaning section 20 includes a housing 21, a cleaning brush 22, a flicker 23, a conveyance member 24, a cleaning blade 25, a blade holder 26, a supporting shaft 27, a spring 28 and such like. The housing 21, cleaning brush 22, flicker 23, conveyance member 24, cleaning blade 25, blade holder 26 and supporting shaft 27 are elongated in the width direction of intermediate transfer belt 17 (direction orthogonal to the sheet surface in FIG. 2).

The housing 21 is formed of an insulating resin and such like, contains the cleaning brush 22, flicker 23 and conveyance member 24 therein and has an opening on the side facing the intermediate transfer belt 17.

The cleaning brush 22 is rotated while contacting the intermediate transfer belt 17 and removes apart of the residues remaining on the surface of the intermediate transfer belt 17.

The flicker 23 is a thin plate member which contacts surfaces of the cleaning brush 22 and scrapes off the residues attached to the cleaning brush 22.

The conveyance member 24 conveys the residues which were scraped from the cleaning brush 22 by the flicker 23, and contains the residues in a collection tank not shown in the drawings.

The cleaning blade 25 is formed of a rigid body such as a metal thin plate and has a thickness of approximately 70 μm. The cleaning blade 25 is located downstream the cleaning brush 22 in the movement direction of intermediate transfer belt 17 (direction shown by the arrow A), and held by the blade holder 26. The tip of the cleaning blade 25 contacts the intermediate transfer belt 17 while being directed to the opposite direction (counter direction) to the movement direction of intermediate transfer belt 17, and the cleaning blade 25 removes the residues attached to the intermediate transfer belt 17. The cleaning blade 25 scrapes and removes, from the intermediate transfer belt 17, the residues which could not be removed by the cleaning brush 22 on the intermediate transfer belt 17. The scraped residues are conveyed by the conveyance member 24 via the cleaning brush 22.

The metallic materials forming the cleaning blade 25 includes stainless steel, iron, copper, brass and such like having a high corrosion resistance, and an especially preferable material is a stainless steel having a high intensity and being less fatigued. The preferable thickness of cleaning blade 25 is approximately 30 to 100 μm in order to well follow the intermediate transfer belt 17.

The blade holder 26 is a member which holds the cleaning blade 25. The blade holder 26 is rotatable around the supporting shaft 27, and the tip of the cleaning blade 25 is pressed onto the surface of intermediate transfer belt 17 by a biasing force of the spring 28 provided to the blade holder 26.

Figure 3:
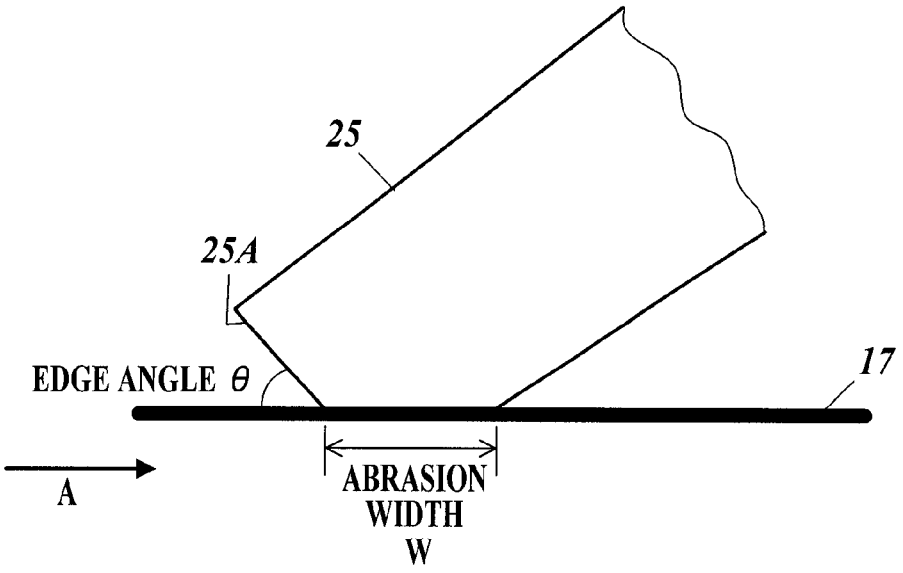
FIG. 3 is a view showing a contact state of a tip of a cleaning blade contacting an intermediate transfer belt.

FIG. 3 shows a contact state of the tip of cleaning blade 25 contacting the intermediate transfer belt 17. The angle between an end surface 25A of the tip of cleaning blade 25 and the surface of the intermediate transfer belt 17 is referred to as an edge angle θ. As the cleaning blade 25 is used, the tip of cleaning blade 25 is abraded by rubbing friction along the movement direction of intermediate transfer belt 17 (direction indicated by the arrow A). The length of abraded part at the tip of cleaning blade 25 along the movement direction of intermediate transfer belt 17 is referred to as an abrasion width W.

Figure 4A:
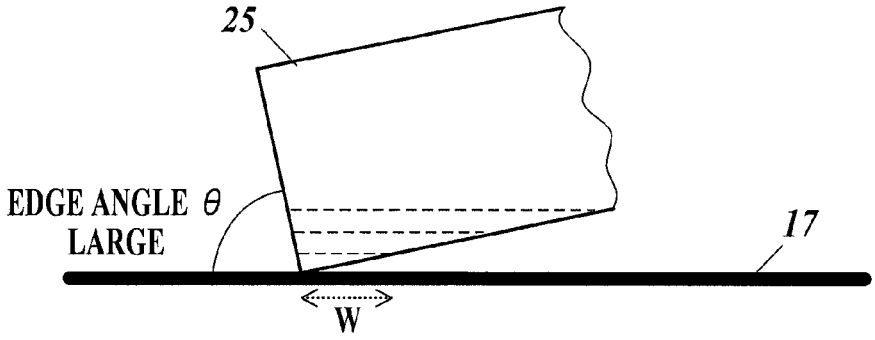
FIG. 4A is a view showing a contact state of the tip of the cleaning blade when an edge angle is relatively large.

As shown in FIG. 4A, in a case where the edge angle θ is relatively large, the abrasion width W according to the use of cleaning blade 25 is increased fast though the cleaning property is high.

Figure 4B:
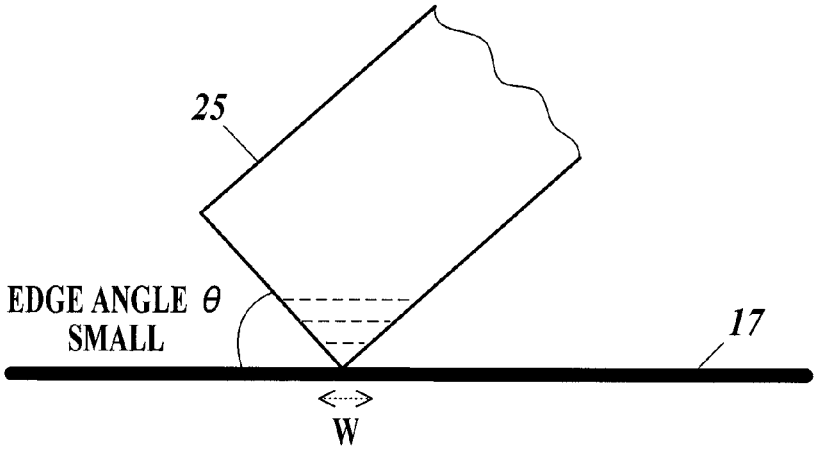
FIG. 4B is a view showing a contact state of the tip of the cleaning blade when the edge angle is relatively small.

On the other hand, as shown in FIG. 4B, in a case where the edge angle θ is relatively small, the abrasion width W according to the use of cleaning blade 25 is increased slowly though the cleaning property is low.

Figure 5:
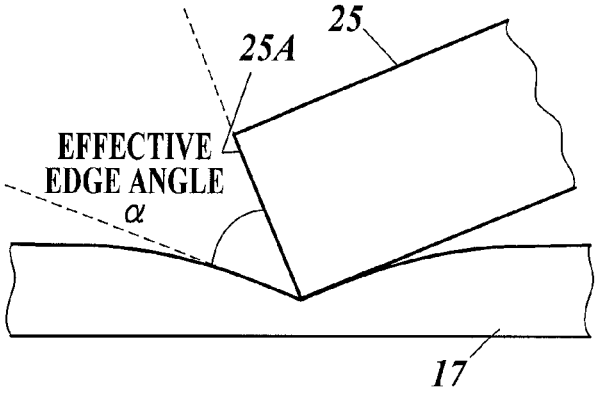
FIG. 5 is a view for explaining an effective edge angle.

With reference to FIG. 5, an effective edge angle α will be described.

The effective edge angle α is an edge angle considering the deformation of elastic layer on the surface of the intermediate transfer belt 17. In a case where the intermediate transfer belt 17 is relatively new and soft (in a case of large elasticity), when the cleaning blade 25 contacts the intermediate transfer belt 17, the tip of cleaning blade 25 is pressed down into the elastic layer of the intermediate transfer belt 17. Thus, as the intermediate transfer belt 17 has a larger elasticity, the effective edge angle α is smaller than the edge angle predicted from the setting state of cleaning blade 25, the effective edge angle α being the angle between the end surface 25A of the tip of cleaning blade 25 and the surface of intermediate transfer belt 17 having the cleaning blade 25 pressed thereto.

Figure 6:
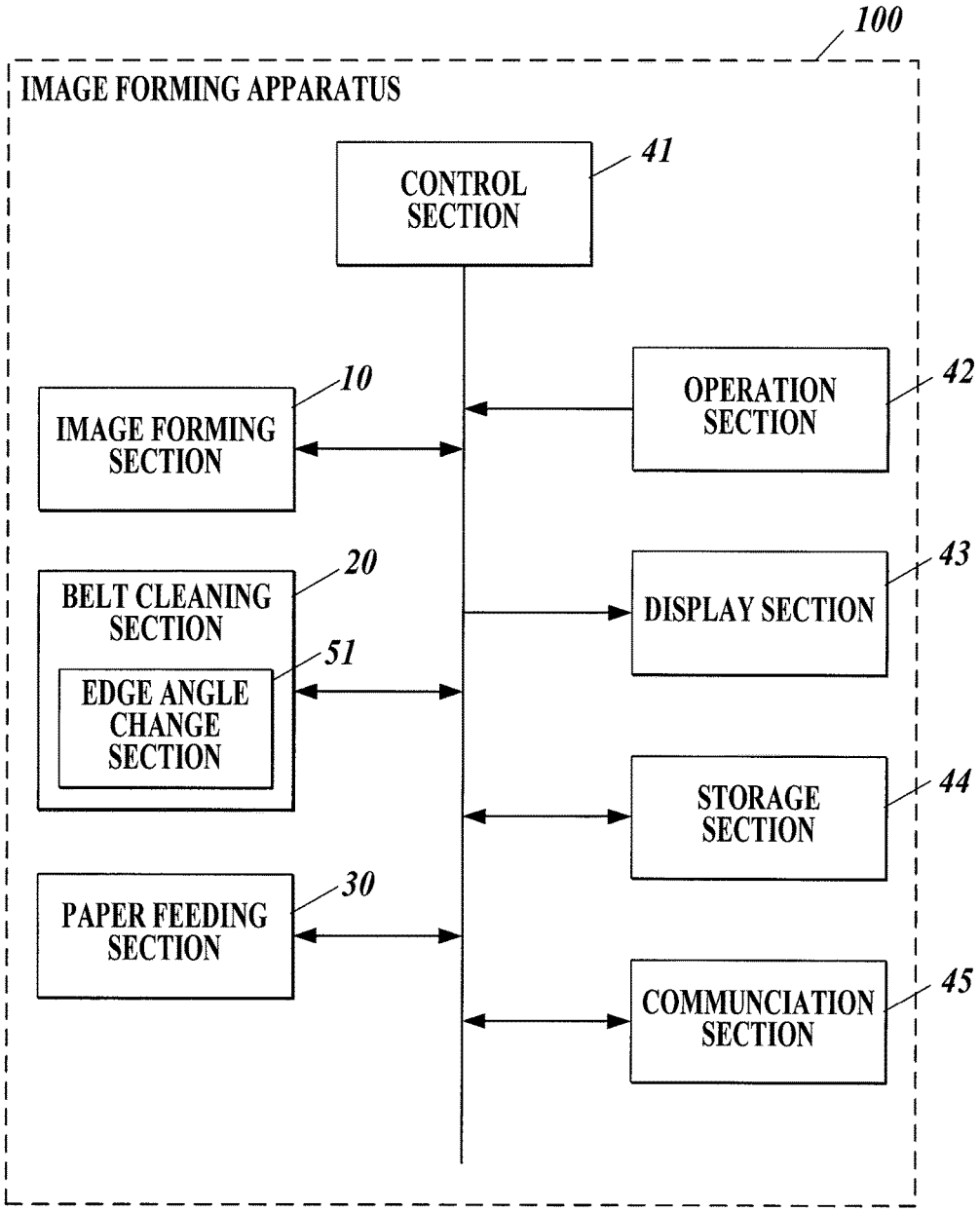
FIG. 6 is a block diagram showing a functional configuration of the image forming apparatus.

FIG. 6 shows the functional configuration of image forming apparatus 100. The image forming apparatus 100 is configured by including the image forming section 10, the belt cleaning section 20, the paper feeding section 30, a control section 41, an operation section 42, a display section 43, a storage section 44, a communication section 45 and such like, and the sections are connected to each other via a bus. The explanation is omitted for the functional sections which have been already described.

The belt cleaning section 20 includes an edge angle changing section 51.

The edge angle changing section 51 is a change section which changes a cleaning condition of the cleaning by cleaning blade 25. Specifically, the edge angle changing section 51 changes the edge angle θ as the cleaning condition, the edge angle θ being the angle between the end surface 25A of tip of the cleaning blade 25 and the surface of intermediate transfer belt 17.

Figure 7A:
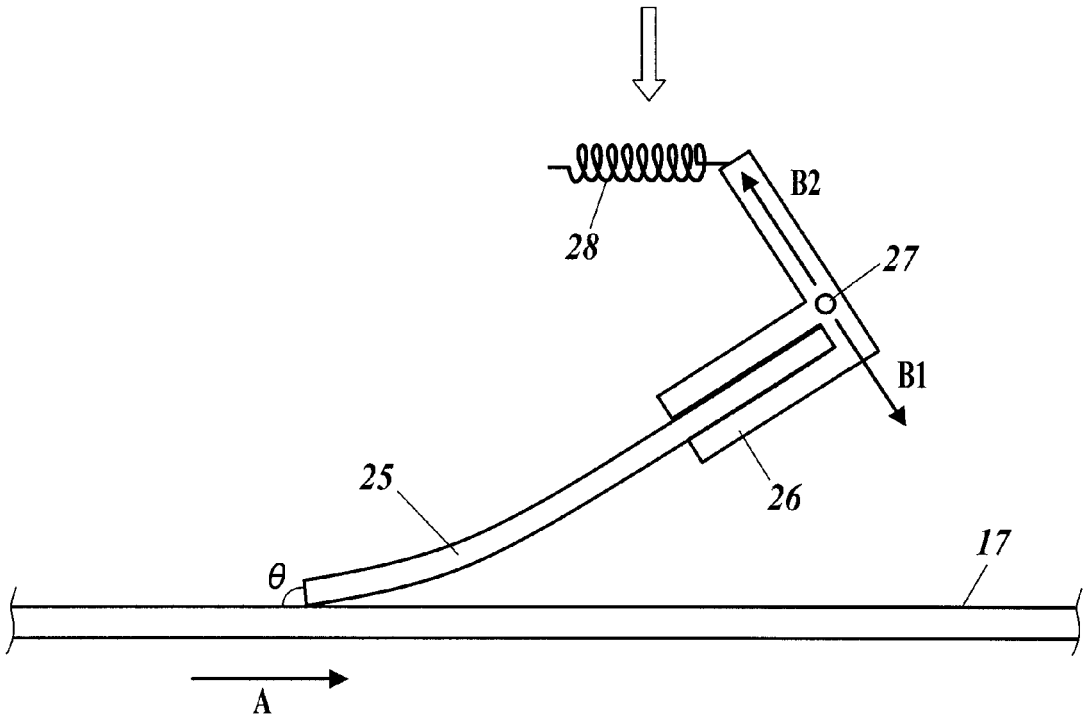
FIG. 7A is a view showing an area around the cleaning blade and the intermediate transfer belt.

FIG. 7A shows the area around the cleaning blade 25 of the belt cleaning section 20 and the intermediate transfer belt 17. The cleaning blade 25 is held by the blade holder 26 and the tip of the cleaning blade 25 contacts the surface of intermediate transfer belt 17 by a biasing force of spring 28.

In the first embodiment, the edge angle changing section 51 changes the edge angle θ by changing the position of supporting shaft 27. When the position of supporting shaft 27 is moved in the arrow B1 direction shown in FIG. 7A, the edge angle θ is increased. On the other hand, when the position of supporting shaft 27 is moved in the arrow B2 direction shown in FIG. 7A, the edge angle θ is decreased.

The control section 41 is configured by including a CPU (Central Processing Unit), a ROM (Read Only Memory), a RAM (Random. Access Memory) and such like, and integrally controls the processing operation of sections of image forming apparatus 100. The CPU reads out various processing programs stored in the ROM, loads them into the RAM and executes the various processing in accordance with the loaded programs.

The operation section 42 includes a touch panel formed so as to cover the display screen of the display section 43 and various operation buttons such as numeric buttons and start button, and outputs an operation signal based on user's operation to the control section 41.

The display section 43 is configured by including an LCD (Liquid Crystal Display), and displays various screens in accordance with the instruction of display signal input from the control section 41.

The storage section 44 is formed of a storage device such as a non-volatile semiconductor memory and hard disk, and stores data regarding the various processing and such like.

The communication section 45 transmits and receives data to and from an external device connected to a network such as a LAN (Local Area Network).

Hereinafter, control regarding the cleaning of intermediate transfer belt 17 will be described.

The control section 41 controls the edge angle changing section 51 to change the cleaning condition of cleaning performed by the cleaning blade 25 in accordance with the deterioration of intermediate transfer belt 17. The control section 41 and the belt cleaning section 20 form a cleaning apparatus according to the present invention.

Specifically, the control section 41 controls the edge angle changing section 51 to change the edge angle θ as the cleaning condition.

Figure 7B:
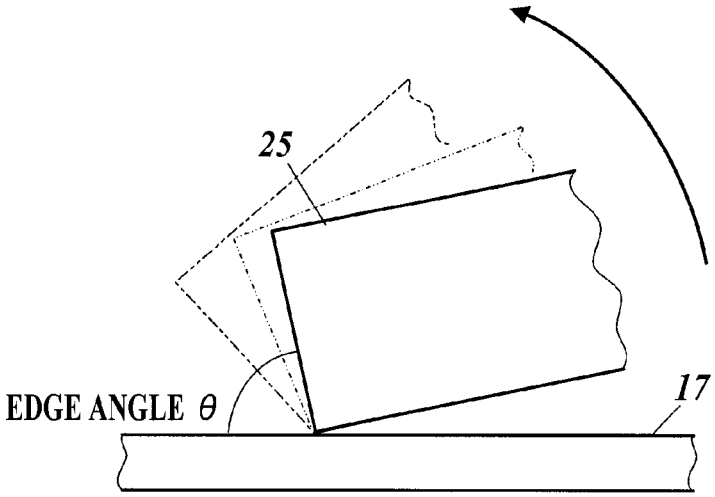
FIG. 7B is a view showing the way the edge angle is reduced.

In accordance with deterioration of the intermediate transfer belt 17, the control section 41 controls the edge angle changing section 51 at a predetermined timing to make the edge angle θ smaller than the edge angle θ before the predetermined timing. That is, as shown in FIG. 7B, the cleaning blade 25 is gradually made to be vertical with respect to the intermediate transfer belt 17.

As described above, the edge angle should be suppressed as much as possible in consideration of abrasion width W of cleaning blade 25. However, when the edge angle is set to be small in a case where the intermediate transfer belt 17 has large electricity, the effective edge angle α is smaller. That is, when the edge angle is set to be small from the beginning of using intermediate transfer belt 17, the effective edge angle α is excessively small, which makes it difficult to ensure cleaning property. Thus, the edge angle needs to be relatively large at the beginning of using the intermediate transfer belt 17 to ensure a required minimum effective edge angle α. When the intermediate transfer belt 17 becomes harder in accordance with deterioration of intermediate transfer belt 17, the pressing down of cleaning blade 25 into the intermediate transfer belt 17 is decreased. Thus, even when the edge angle is made smaller, the cleaning property can be maintained and the abrasion of cleaning blade 25 can be suppressed.

As for the timing to change the edge angle, for example, the control section 41 controls the edge angle changing section 51 to decrease the edge angle θ when the number of sheets P having the toner images transferred thereon from the intermediate transfer belt 17 exceeds a predetermined value. Specifically, the image forming apparatus 100 is provided with a counter which counts the number of sheets P which have been subjected to the processing from the start of newly using the intermediate transfer belt 17. The control section 41 recognizes the number of sheets P on the basis of the value of counter. The predetermined value may be set to a plurality of values so that the edge angle θ is gradually changed in a plurality of steps.

Further, when the amount of toner consumption exceeds a predetermined amount, the control section 41 controls the edge angle changing section 51 to decrease the edge angle θ. Specifically, the control section 41 calculates the amount of toner consumption from the start of newly using the intermediate transfer belt 17 on the basis of the toner remaining amount of toner cartridge containing the toner. The predetermined amount may be set to a plurality of amounts so that the edge angle θ is gradually changed in a plurality of steps.

As described above, according to the first embodiment, the cleaning condition is changed in accordance with deterioration of intermediate transfer belt 17. Thus, the cleaning property can be maintained over a long period for the cleaning of intermediate transfer belt 17 having an elastic layer.

For example, by changing the edge angle as a cleaning condition which is an angle between the end surface 25A of tip of cleaning blade 25 and the surface of intermediate transfer belt 17, the cleaning condition can be changed easily at low cost. Specifically, the edge angle is changed at a predetermined timing so as to be smaller than the edge angle before the predetermined timing. Thus, the cleaning property can be maintained while suppressing the abrasion of cleaning blade 25.

Furthermore, the load on users or servicemen of image forming apparatus 100 such as downtime, working time and working cost for part replacement is reduced and the working efficiency can be improved.

The number of sheets P having the toner images transferred thereon from the intermediate transfer belt 17 and the amount of toner consumption can be used as an index of deterioration of intermediate transfer belt 17 to decrease the edge angle.

Second Embodiment

Next, a second embodiment applying the present invention will be described.

The image forming apparatus in the second embodiment has nearly same configurations as those of the image forming apparatus 100 shown in the first embodiment. Thus, same reference numerals are used for the same configurations, and the illustration and explanation thereof are omitted. Hereinafter, the configuration and processing characteristic to the second embodiment will be described.

In the image forming apparatus in the second embodiment, the belt cleaning section 20 includes a cleaning blade 61 instead of the cleaning blade 25.

Figure 8A:
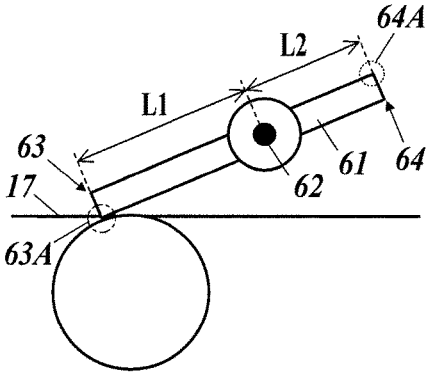
FIG. 8A is a view showing a configuration of a cleaning blade of an image forming apparatus in a second embodiment.

FIG. 8A shows the configuration of cleaning blade 61. The cleaning blade 61 has a rotation shaft 62 on the cleaning blade 61 along the width direction of intermediate transfer belt 17 (direction orthogonal to sheet surface of FIG. 8A) at a position which has different lengths from respective ends 63 and 64 of cleaning blade 61. The cleaning blade 61 is supported so as to be rotatable around the rotation shaft 62. The length L1 from the one end 63 of cleaning blade 61 to the rotation shaft 62 is longer than the length L2 from the other end 64 of cleaning blade 61 to the rotation shaft 62.

The end 63 or 64 of cleaning blade 61 is pressed to the surface of intermediate transfer belt 17 by a biasing force or the like of a spring similarly to the cleaning blade 25.

In the second embodiment, the edge angle changing section 51 changes the edge angle by rotating the cleaning blade 61 around the rotation shaft 62.

In an initial state of intermediate transfer belt 17, the control section 41 controls the edge angle changing section 51 to rotate the cleaning blade 61 so that the end 63 of cleaning blade 61 having a longer length from the rotation shaft 62 is in contact with the intermediate transfer belt 17. At this time, the edge part 63A which is a corner part on the intermediate transfer belt 17 side of the end 63 of cleaning blade 61 contacts the intermediate transfer belt 17.

Figure 8B:
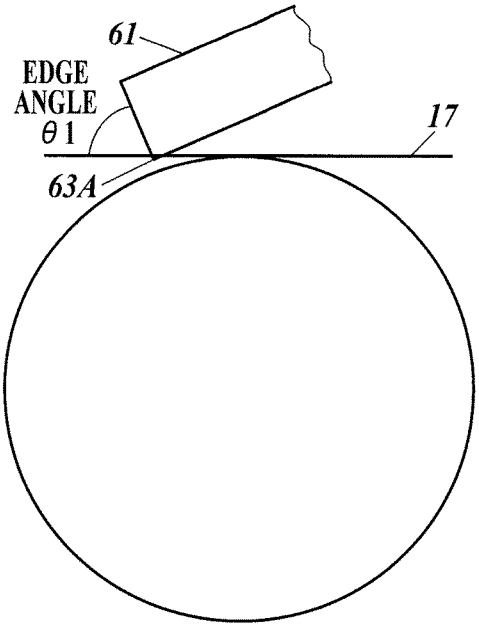
FIG. 8B is an enlarged view of the contacting part of the cleaning blade in FIG. 8A.

FIG. 8B is an enlarged view showing a state in which the edge part 63A is in contact with the intermediate transfer belt 17. The edge angle when the edge part 63A of cleaning blade 61 is in contact with the intermediate transfer belt 17 is referred to as θ1.

The control section 41 controls the edge angle changing section 51 to change the cleaning condition of cleaning by the cleaning blade 61 in accordance with the deterioration of intermediate transfer belt 17.

Specifically, the control section 41 controls the edge angle changing section 51 to change the edge angle as the cleaning condition.

The control section 41 controls the edge angle changing section 51 at a predetermined timing to change the contact state from a state in which the end 63 of the cleaning blade 61 having a longer length from the rotation shaft 62 contacts the intermediate transfer belt 17 to a state in which the end 64 of the cleaning blade 61 having a shorter length from the rotation shaft 62 contacts the intermediate transfer belt 17. The edge angle is decreased by rotating the cleaning blade 61 so as to shorten the length between the rotation shaft 62 and the end of cleaning blade 61 contacting the intermediate transfer belt 17.

Figure 9A:
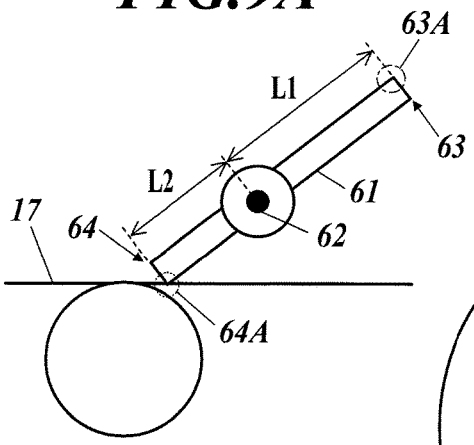
FIG. 9A is a view showing a state after the cleaning blade was rotated.

FIG. 9A shows the cleaning blade 61 after the cleaning blade 61 was rotated. The end 64 of cleaning blade 61 having a shorter length from the rotation shaft 62 is in contact with the intermediate transfer belt 17. At this time, the edge part 64A which is a corner part on the intermediate transfer belt 17 side of the end 64 of cleaning blade 61 is made to contact with the intermediate transfer belt 17.

Figure 9B:
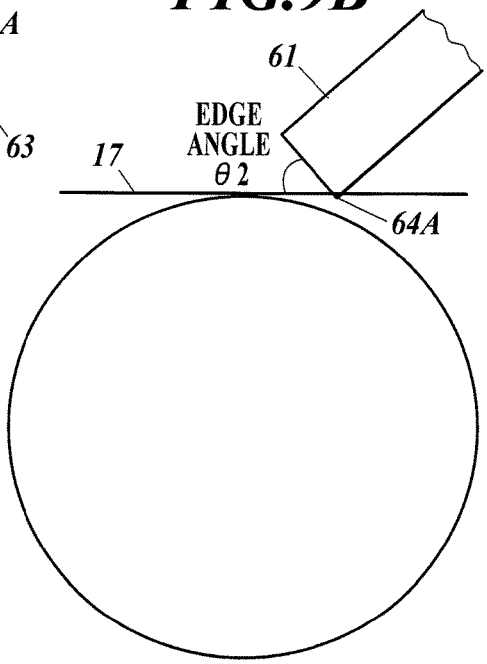
FIG. 9B is an enlarged view of a contacting part of the cleaning blade in FIG. 9A.

FIG. 9B is an enlarged view showing a state in which the edge part 64A is in contact with the intermediate transfer belt 17. The edge angle θ2, which is an angle when the edge part 64A of cleaning blade 61 is in contact with the intermediate transfer belt 17, is smaller than the edge angle θ1 shown in FIG. 8B.

The predetermined timing to change the edge angle is, for example, when the number of sheets P having toner images transferred thereon from the intermediate transfer belt 17 exceeds a predetermined value, and when the amount of toner consumption exceeds a predetermined amount.

As described above, according to the second embodiment, the cleaning condition is changed in accordance with deterioration of intermediate transfer belt 17. Thus, the cleaning property can be maintained over a long period for the cleaning of intermediate transfer belt 17 having an elastic layer.

Specifically, at a predetermined timing, the edge angle is made smaller than the edge angle before the predetermined timing by changing the contact state from a state in which the end 63 of cleaning blade 61 having a longer length from rotation shaft 62 is in contact with the intermediate transfer belt 17 to a state in which the end 64 of cleaning blade 61 having a shorter length from the rotation shaft 62 is in contact with the intermediate transfer belt 17. Thus, the cleaning property can be maintained while suppressing the abrasion of cleaning blade 61.

Figure 10:
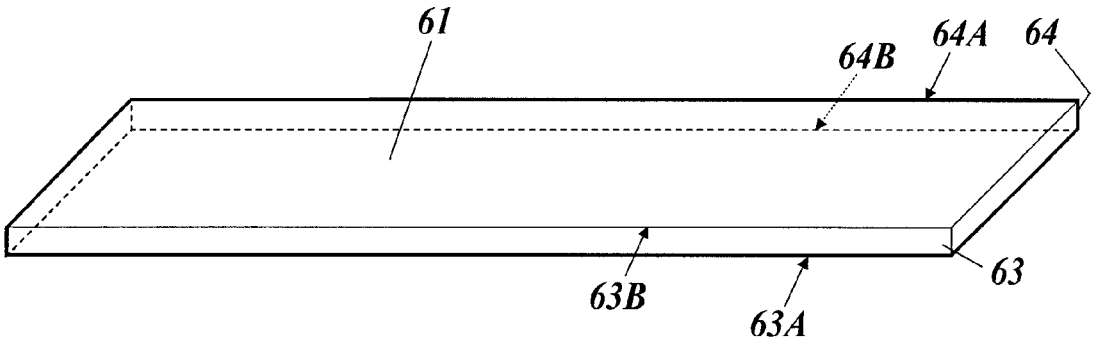
FIG. 10 is a view showing an edge part of the cleaning blade.

The cleaning blade 61 has a configuration which is nearly a rectangular parallelepiped as shown in FIG. 10. The second embodiment has been described for a case of using the edge parts 63A and 64A of cleaning blade 61 so as to contact the intermediate transfer belt 17. However, the other edge parts 63B and 64B may be added to use the four edge parts 63A, 64A, 63B and 64B in rotation. This can achieve a longer life of cleaning blade 61.

In the second embodiment, the edge part (corner part) to contact the intermediate transfer belt 17 is changed by rotating the cleaning blade 61 at a predetermined timing. The method for changing the edge part is not limited to this. The edge part to contact the intermediate transfer belt 17 may be changed by automatically moving the cleaning blade 61 at a predetermined timing. Alternatively, the servicemen or the like may manually reattach the cleaning blade 61.

Third Embodiment

Next, a third embodiment applying the present invention will be described.

The image forming apparatus in the third embodiment has a nearly same configuration as that of image forming apparatus 100 shown in the first embodiment. Thus, same reference numerals are used for the same configuration parts, and illustration and explanation of the configuration parts are omitted. Hereinafter, the configuration and processing characteristic to the third embodiment will be described.

Figure 11A:
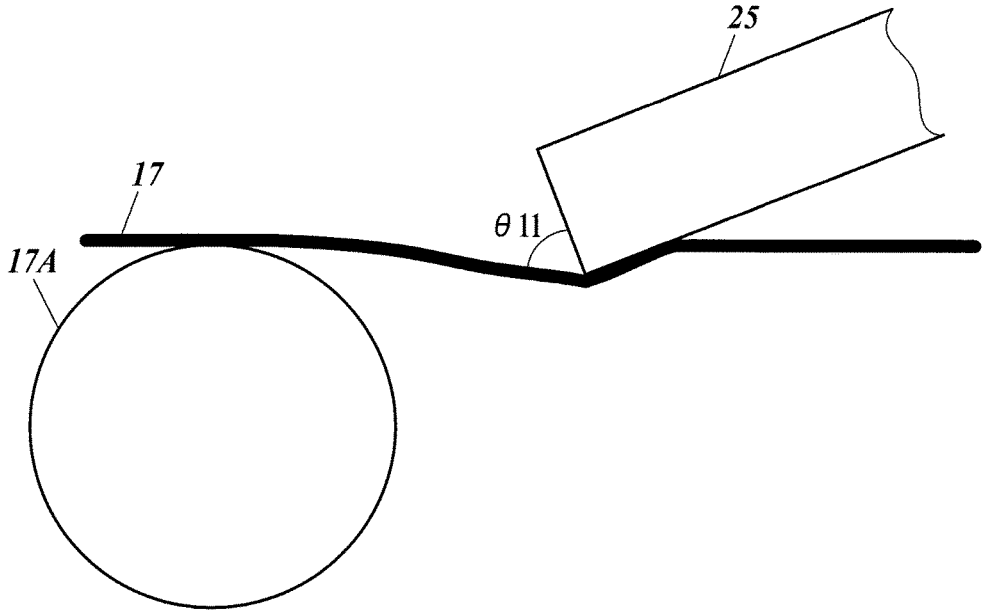
FIG. 11A is a view showing a positional relationship between a cleaning blade and an facing roller in an image forming apparatus in a third embodiment.
Figure 11B:
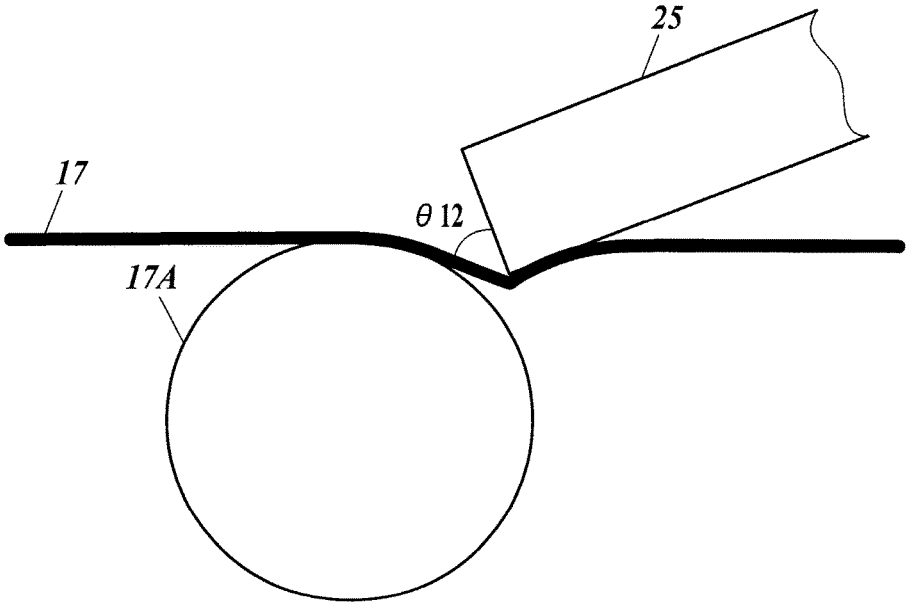
FIG. 11B is a view showing a case where the distance between the cleaning blade and the facing roller is shortened.

Each of FIGS. 11A and 11B shows a positional relationship between the cleaning blade 25 and a roller (hereinafter, referred to as a facing roller) 17A facing the cleaning blade 25.

In the third embodiment, the edge angle changing section 51 changes the positional relationship between the cleaning blade 25 and the facing roller 17A which is facing the cleaning blade via the intermediate transfer belt 17. In this description, the position of cleaning blade 25 is fixed, and the edge angle changing section 51 moves the position of facing roller 17A along the movement direction of intermediate transfer belt 17.

The control section 41 controls the edge angle changing section 51 to change the cleaning condition of cleaning by the cleaning blade 25 in accordance with deterioration of the intermediate transfer belt 17.

Specifically, the control section 41 controls the edge angle changing section 51 to change the edge angle as the cleaning condition.

At a predetermined timing, the control section 41 controls the edge angle changing section 51 to make the distance between the cleaning blade 25 and the facing roller 17A shorter than the distance before the predetermined timing.

In an initial state of intermediate transfer belt 17, the control section 41 first controls the edge angle changing section 51 to locate the facing roller 17A at the position shown in FIG. 11A.

At a predetermined timing, the control section 41 controls the edge angle changing section 51 to move the facing roller 17A from the position shown in FIG. 11A to the position shown in FIG. 11B. As shown in FIG. 11B, by making the distance between the cleaning blade 25 and the facing roller 17A shorter than the distance shown in FIG. 11A, the edge angle is changed from θ11 to θ12 to be reduced.

The predetermined timing to change the edge angle is, for example, when the number of sheets P having toner images transferred thereon from the intermediate transfer belt 17 exceeds a predetermined value and when the amount of toner consumption exceeds a predetermined amount.

Figure 12:
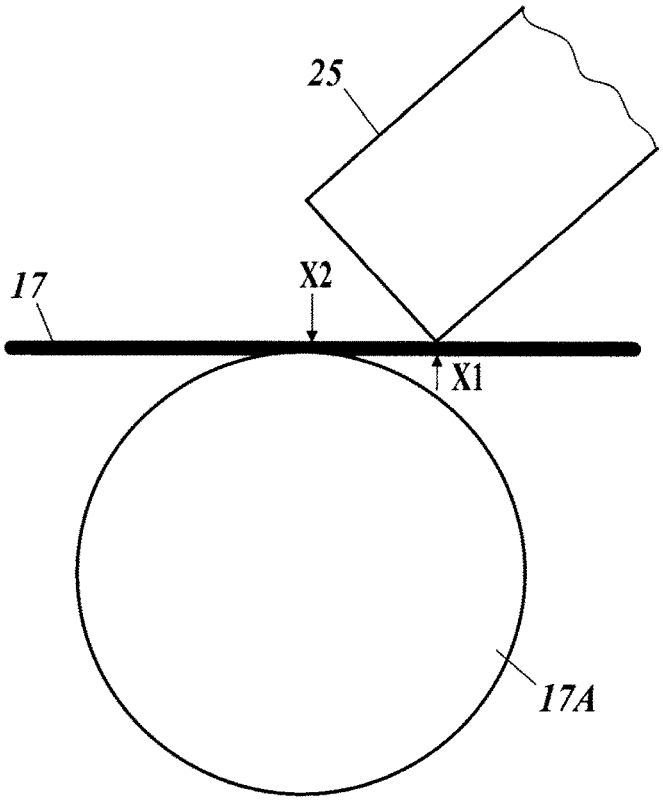
FIG. 12 is a view showing locations of cleaning blade and facing roller with respect to the intermediate transfer belt.

As shown in FIG. 12, the control section 41 controls the edge angle changing section 51 so that the position X1 where the cleaning blade 25 contacts the intermediate transfer belt 17 is different from the position X2 where the facing roller 17A contacts the intermediate transfer belt 17. That is, the control section 41 controls so that the facing roller 17A is not located directly below the cleaning blade 25.

As described above, according to the third embodiment, the cleaning condition is changed in accordance with deterioration of the intermediate transfer belt 17. Thus, the cleaning property can be maintained over a long period for the cleaning of intermediate transfer belt 17 having an elastic layer.

Specifically, at a predetermined timing, by making the distance between the cleaning blade 25 and the facing roller 17A shorter than the distance before the predetermined timing, the edge angle is made smaller than the edge angle before the predetermined timing. Thus, the cleaning property can be maintained while suppressing the abrasion of cleaning blade 25.

In a configuration in which the facing roller 17A is located directly below the part (edge part) of cleaning blade 25 contacting the intermediate transfer belt 17, the cleaning blade 25 is partially floated by a stuff attached to the back surface of intermediate transfer belt 17 and cleaning defect is generated.

According to the third embodiment, the position X1 where the cleaning blade 25 contacts the intermediate transfer belt 17 is different from the position X2 where the facing roller 17A contacts the intermediate transfer belt 17, and thus, the cleaning defect can be prevented.

The third embodiment has been described for a case where the position of facing roller 17A is moved to change the positional relationship between the cleaning blade 25 and the facing roller 17A. However, the position of cleaning blade 25 may be moved.

The descriptions of the above embodiments are examples of cleaning apparatus, image forming apparatus and cleaning method according to the present invention, and the present invention is not limited to the examples. The detailed configurations and detailed operations of the sections forming the apparatuses can be appropriately changed within the scope of the present invention.

For example, the characteristic configurations and operations in the embodiments may be combined.

The embodiments have been described for a case where the edge angle is changed as the cleaning condition. However, a contact pressure of cleaning blades 25 and 61 with respect to the intermediate transfer belt 17 may be changed.

The cleaning blades 25 and 61 may be formed of a material other than metal as long as the edge part is a non-deformed member which enables the above-mentioned cleaning configuration. The non-deformed member of edge part includes resin in addition to metal. However, the cleaning blades 25 and 61 made of metal have a higher effect of stably ensuring the cleaning property over a long period.

Though the main material is not metal, the cleaning blades 25 and 61 may use a member having the surface coated with metal and a member having a non-deformed edge part to contact the intermediate transfer belt 17. That is, the cleaning blades 25 and 61 may be formed of any material as long as the member of the part contacting the intermediate transfer belt 17 is a non-deformed member such as metal and resin.

The entire disclosure of Japanese Patent Application No. 2015-224354 filed on Nov. 17, 2015 including description, claims, drawings, and abstract are incorporated herein by reference in its entirety.

What is claimed is:

1. A cleaning apparatus which cleans an image carrier that has an elastic layer after a toner image formed on the image carrier is transferred onto a transfer object, the cleaning apparatus comprising:

a cleaning blade which contacts the image carrier and removes a residue attached to the image carrier;

a change section which changes a cleaning condition of cleaning by the cleaning blade;

a hardware processor which controls the change section to change an edge angle in accordance with deterioration of the image carrier, the edge angle being an angle between an end surface of a tip of the cleaning blade and a surface of the image carrier; and the hardware processor is configured to control the change section at a predetermined timing to make the edge angle smaller than the edge angle before the predetermined timing, wherein the image carrier possesses a longitudinal direction and possesses a width direction perpendicular to the longitudinal direction, the cleaning blade has a rotation shaft extending along the width direction of the image carrier, the rotation shaft being located at a position which is closer to one end of the cleaning blade than to an opposite end of the cleaning blade, the change section rotates the cleaning blade around the rotation shaft, and the hardware processor controls the change section at the predetermined timing to change a contact state from a state in which the opposite end of the cleaning blade having a longer length from the rotation shaft contacts the image carrier to a state in which the one end of the cleaning blade having a shorter length from the rotation shaft contacts the image carrier.

2. A cleaning method for a cleaning apparatus which includes a cleaning blade, a change section and a hardware processor and cleans an image carrier that has an elastic layer after a toner image formed on the image carrier is transferred onto a transfer object, the image carrier possessing a longitudinal direction and possessing a width direction perpendicular to the longitudinal direction, the cleaning blade having a rotation shaft extending along the width direction of the image carrier, the rotation shaft being located at a position which is closer to one end of the cleaning blade than to an opposite end of the cleaning blade, the cleaning method comprising:

contacting the image carrier and removing a residue attached to the image carrier with the cleaning blade;

rotating the cleaning blade around the rotation shaft with the change section; and controlling the change section to change an edge angle in accordance with deterioration of the image carrier with the hardware processor, the edge angle being an angle between an end surface of a tip of the cleaning blade and a surface of the image carrier, the hardware processor controlling the change section at a predetermined timing to change a contact state from a state in which the opposite end of the cleaning blade having a longer length from the rotation shaft contacts the image carrier to a state in which the one end of the cleaning blade having a shorter length from the rotation shaft contacts the image carrier to make the edge angle smaller than the edge angle before the predetermined timing.

3. A cleaning apparatus which cleans an image carrier that has an elastic layer after a toner image formed on the image carrier is transferred onto a transfer object, the image carrier possessing a first surface and a second surface opposite the first surface, the cleaning apparatus comprising:

a cleaning blade which contacts the first surface of the image carrier and removes a residue attached to the image carrier, a position of the cleaning blade being fixed, the image carrier being conveyed in a movement direction;

a roller which faces the cleaning blade via the image carrier by being positioned to contact the second surface of the image carrier, a position of the roller being changeable in the movement direction of the image carrier;

a change section which changes a cleaning condition of cleaning by the cleaning blade; and a hardware processor which controls the change section to change an edge angle in accordance with deterioration of the image carrier, the edge angle being an angle between an end surface of a tip of the cleaning blade and a surface of the image carrier, wherein the change section changes a positional relationship between the cleaning blade and the roller facing the cleaning blade via the image carrier, the hardware processor controls the change section so that a position where the cleaning blade contacts the image carrier is different from a position where the roller contacts the image carrier, and the hardware processor controls the change section at a predetermined timing to make the edge angle smaller than the edge angle before the predetermined timing by moving the roller along the movement direction of the image carrier to make a distance between the cleaning blade and the roller shorter than the distance before the predetermined timing.

4. A cleaning method for a cleaning apparatus which includes a cleaning blade, a roller, a change section and a hardware processor and cleans an image carrier that has an elastic layer after a toner image formed on the image carrier is transferred onto a transfer object, the image carrier possessing a first surface and a second surface opposite the first surface, a position of the cleaning blade being fixed, the roller facing the cleaning blade via the image carrier, the cleaning method comprising:

conveying the image carrier in a movement direction;

contacting the first surface of the image carrier and removing a residue attached to the image carrier with the cleaning blade while the image carrier is being conveyed in the movement direction;

changing a cleaning condition of cleaning with the change section by changing a positional relationship between the cleaning blade and the roller facing the cleaning blade, the roller being positioned to contact the second surface of the image carrier, a position of the roller being changeable in the movement direction of the image carrier; and controlling the change section to change an edge angle in accordance with deterioration of the image carrier with the hardware processor, the edge angle being an angle between an end surface of a tip of the cleaning blade and a surface of the image carrier, the hardware processor controlling the change section so that a position where the cleaning blade contacts the image carrier is different from a position where the roller contacts the image carrier, and the hardware processor controls the change section at a predetermined timing to make a distance between the cleaning blade and the roller shorter than the distance before the predetermined timing by moving the roller along the movement direction of the image carrier to thereby make the edge angle smaller than the edge angle before the predetermined timing.

* * * * *